US005567016A

United States Patent [19]

Koprowski

[11] Patent Number: 5,567,016

[45] Date of Patent: Oct. 22, 1996

[54] HANDICAPPED ACCESSIBLE AUDITORIUM SEAT

[75] Inventor: Richard A. Koprowski, New Franken, Wis.

[73] Assignee: Krueger International, Inc., Green Bay, Wis.

[21] Appl. No.: 534,346

[22] Filed: Sep. 27, 1995

Related U.S. Application Data

[63] Continuation of Ser. No. 186,432, Jan. 25, 1994, abandoned.

[51] Int. Cl.[6] ..... A47C 7/54

[52] U.S. Cl. ..... 297/411.32

[58] Field of Search ..... 297/113, 115, 297/232, 248, 331, 335, 411.32, 411.38

[56] References Cited

U.S. PATENT DOCUMENTS

| | | | |
|---|---|---|---|
| 540,699 | 6/1895 | Smith | 297/335 |
| 3,544,163 | 12/1970 | Krein | 297/411.32 |
| 3,655,239 | 4/1972 | Agosti | 297/331 |
| 3,807,299 | 4/1974 | Freedman | 297/411.32 |
| 4,118,069 | 10/1978 | Hunter | 297/411.32 X |
| 4,310,196 | 1/1982 | Vogel | 297/411.32 |
| 4,848,840 | 7/1989 | Toya | 279/411.32 |
| 5,033,792 | 7/1991 | Kanazawa | 297/411.32 |

FOREIGN PATENT DOCUMENTS

| | | | |
|---|---|---|---|
| 1071304 | 12/1959 | Germany | 297/335 |
| 3344207 | 6/1985 | Germany | 297/411.32 |

*Primary Examiner*—Peter R. Brown
*Attorney, Agent, or Firm*—Andrus, Sceales, Starke & Sawall

[57] ABSTRACT

A chair located on an aisle of a theatre, arena, stadium or the like, which is easily accessible from a walker or wheelchair. The chair has an armrest proximal to the aisle which pivots in an upwardly manner providing an unobstructed path into the chair. Once the individual is seated, the armrest can be pivoted in a downwardly manner so that the occupant of the chair can use the armrest in comfort.

10 Claims, 3 Drawing Sheets

FIG. 5
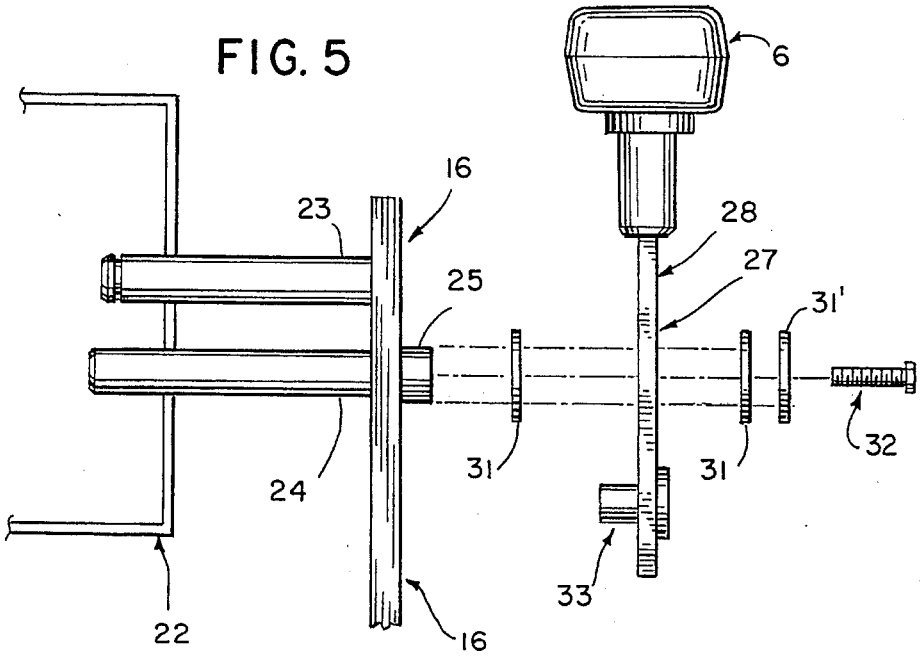
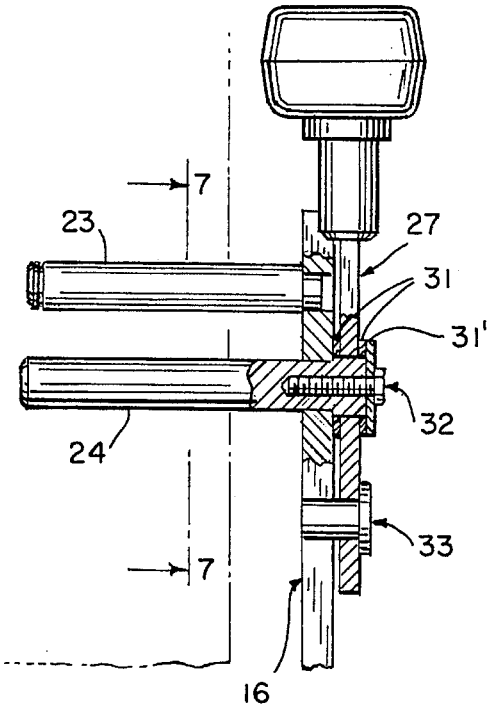
FIG. 6
FIG. 7
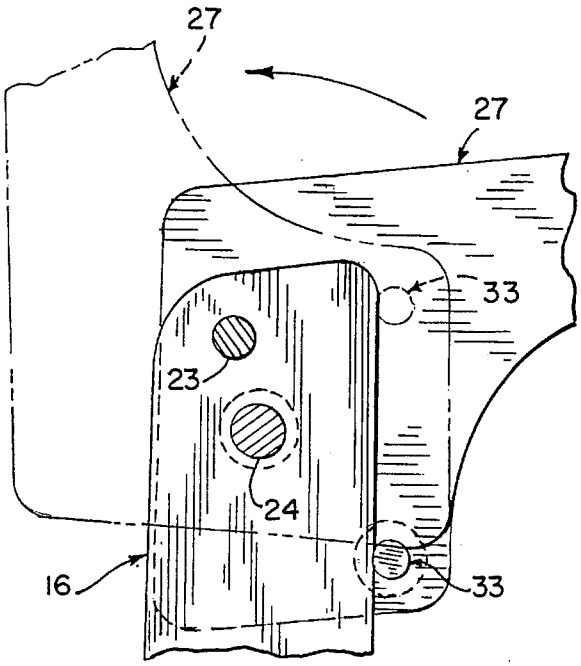

HANDICAPPED ACCESSIBLE AUDITORIUM SEAT

CROSS REFERENCE TO RELATED APPLICATION

This application is a file wrapper continuation of application Ser. No. 08/186,432, filed Jan. 25, 1994, now abandoned.

FIELD OF THE INVENTION

The present invention relates to a chair especially designed for handicapped individuals; more specifically the present invention relates to a chair which is adapted for placement on the aisle in a theatre or the like for providing easy access from a wheelchair or walker.

BACKGROUND OF THE INVENTION

Chairs in theaters, stadiums, arenas, and playhouses have static armrests making it difficult for individuals to be seated. This is especially true for handicapped individuals who have walkers, canes or are confined to a wheelchair. In fact, it is extremely difficult to transfer an individual from his or her wheelchair into a conventional theatre chair due to the obstructing static armrest.

SUMMARY OF THE INVENTION

It is an object of the present invention to provide a fixed seat or chair in which a handicapped individual can easily sit down in the chair from a walker or easily be transferred from a wheelchair. Another object of the invention is to provide a chair adapted for use in a facility required to comply with the American Disabilities Act, which requires public places to be handicapped accessible and to have handicapped facilities. A further object of the invention is to provide a handicapped accessible feature for a chair which can easily be incorporated into a chair without detracting from the operation of the chair or from the overall aesthetic appearance of the chair.

In accordance with the invention, a handicapped accessible chair is adapted for placement at the end of a row of chairs adjacent to an aisle. The handicapped accessible chair includes a seat cushion and a back cushion and has a pivoting aisle arm rest which can be lifted from a horizontal user position to a vertical transfer position so that it is parallel to the back of the chair, thereby allowing a handicapped individual easy access into and out of the chair. Once the handicapped individual is seated in the chair, the arm rest can be pulled down into its user position so that the individual may use the arm rest in a conventional manner. The chair includes a base to which the seat cushion is mounted, and the base is constructed so as not to extend over the top of the seat cushion, thus eliminating the base as an obstruction to being seated. A support connects the seat cushion and the back cushion to the base, and the support is designed to extend below both the seat cushion and behind the back cushion, thereby providing easy access to the chair.

The invention will be further understood by reference to the accompanying drawings and following detailed description.

BRIEF DESCRIPTION OF THE DRAWINGS

The drawings illustrate the best mode contemplated of carrying out the invention.

In the drawings:

FIG. 5 is an exploded front elevation view of the pivoting arm rest of FIGS. 2–4.

FIG. 6 is a frontal elevation view of the pivoting arm rest of FIGS. 2–5 with parts broken away.

FIG. 7 is a cross sectional view along lines 7—7 of FIG. 6.

DETAILED DESCRIPTION OF THE PREFERRED EMBODIMENT

Figure 1:
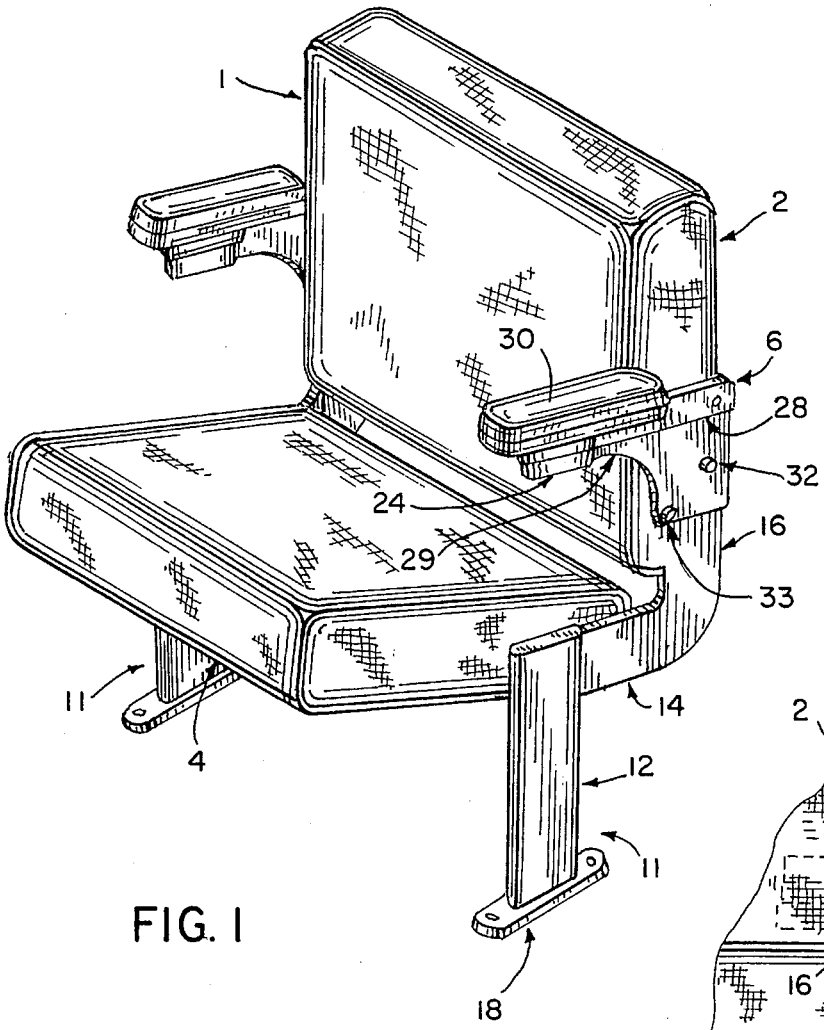
FIG. 1 is a perspective view of a chair constructed in accordance with the present invention.
Figure 2:
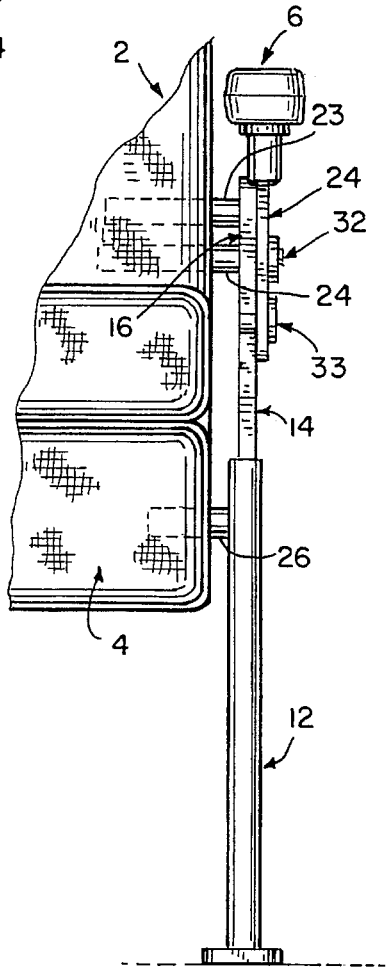
FIG. 2 is a front elevation view of a portion of the chair of FIG. 1, showing the pivoting arm rest.

FIG. 1 illustrates a seating assembly 1 which has a back 2, a seat 4, and a movable arm assembly 6. Seating assembly 1 is generally constructed according to the disclosure of pending patent application Ser. No. 07/959,980 filed Oct. 13, 1992, the disclosure of which is hereby incorporated by reference. Seating assembly 1 is adapted for placement at the end of a row of similarly constructed seating assemblies, such that movable arm assembly 6 is on an aisle. Arm assembly 6 is movable between a first, operable user position shown in FIG. 3 and a second, transfer position shown in FIG. 4.

Seating assembly 1 is secured to the floor or other supporting surface via a base assembly 11 including a vertical support 12, a rearwardly extending transverse member 14 and an upwardly extending member 16 formed intergrally with transverse member 14. Seating assembly 1 is mounted to the floor or other supporting surface by means of a floor plate 18 welded to the lower end of vertical support 12, and a pair of bolts 20 (FIG. 3) which extend through openings in floor plate 18 and into the floor.

A base assembly 11' constructed as shown and described in the above-referenced patent application, is located at the side of seating assembly 1 opposite base assembly 11.

Figure 3:
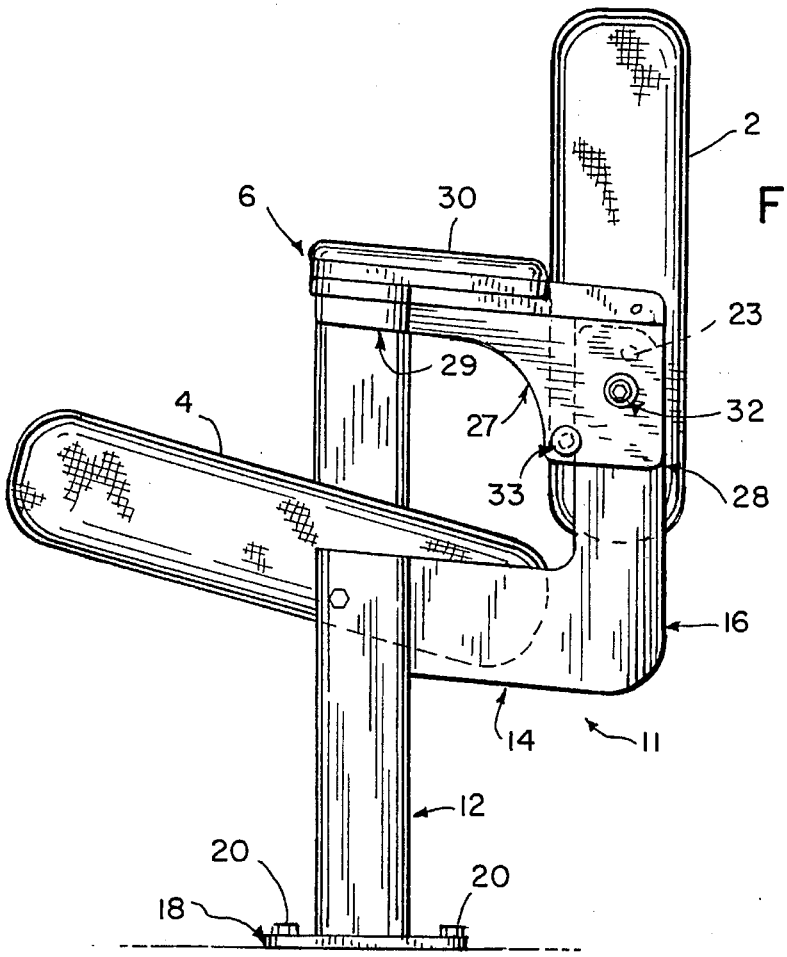
FIG. 3 is a side elevation view of the chair of FIG. 1 showing the pivoting arm rest in its user position.
Figure 4:
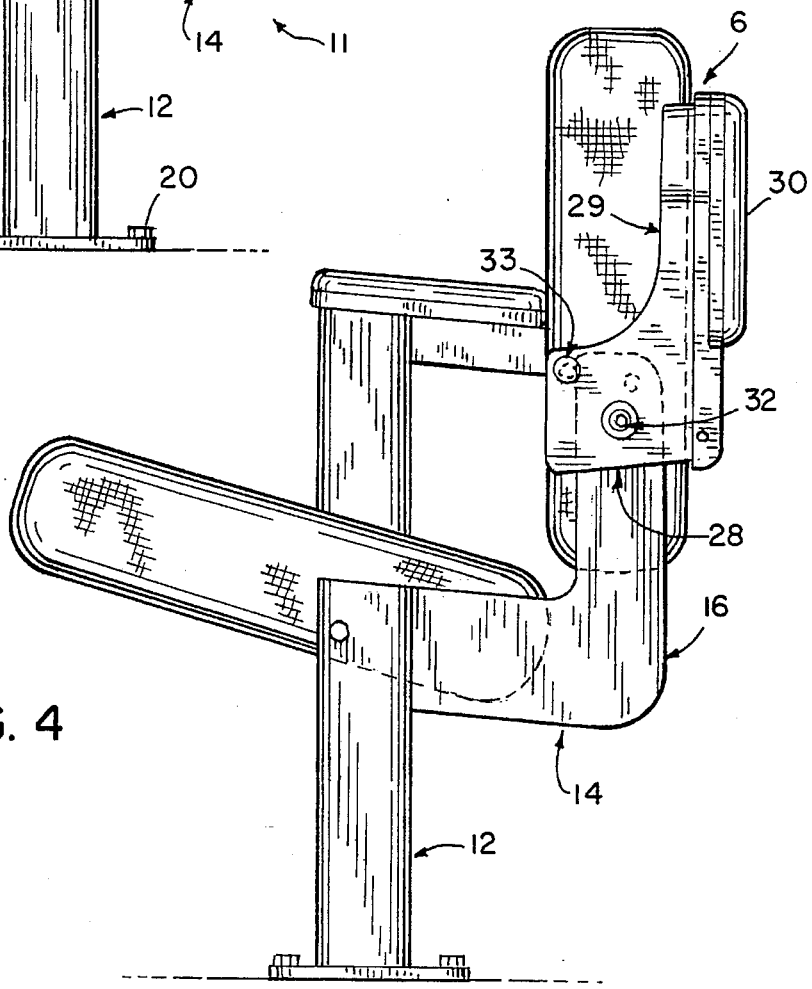
FIG. 4 is a side elevation view similar to FIG. 3 showing the pivoting arm rest in its transfer position.

Back 2 is pivotably mounted to base assembly 11' and to upwardly extending member 16 of base assembly 11 in the manner disclosed in the above-referenced pending application. Back 2 is movable between a vertical position, as shown in FIGS. 1, 3 and 4 and a tilted use position according to user requirements. When not in use, back 2 returns to its vertical, upright position. Likewise, seat 4 is pivotably connected to the vertical supports such as 12, of base assemblies 11, 11' in a manner as disclosed in the above-referenced pending application. Seat 4 is pivotable between a user position, as shown in FIGS. 1, 3 and 4 and an upright, vertical storage position when not in use.

Referring to FIG. 3, back 2 is mounted for pivoting movement via a pivot housing 22 to a pivot pin 23 which extends inwardly from upwardly extending member 16. A stop pin 24, also extending inwardly from upwardly extending member 16, controls the range of pivoting movement of back 2 relative to base assembly 11. A portion of stop pin 24, shown at 25, extends outwardly from upwardly extending member 16. Similarly, a pivot pin 26 extends inwardly from vertical support 12, and seat 4 is pivotably mounted to pin 26. Pins similar to pins 23, 24 and 26 are mounted to base assembly 11' for pivotably supporting the opposite sides of seat 2 and back 4.

Base assembly 11 is constructed so as not to extend beyond the surfaces of back 2 and seat 4 which support the user. That is, the upper end of vertical support 12 terminates below the upper surface of seat 4 when seat 4 is positioned so as to seat a user. Likewise, the upper edge of rearwardly extending member 14 does not extend above the upper surface of seat 4, and the forward edge of upwardly extending member 16 does not extend past the front surface of back 2, when back 2 is positioned so as to seat a user. In this manner, the components of base assembly 11 do not interfere with horizontal movement of a user onto seat 4 and back 2.

Referring to FIGS. 1, 2, 5 and 6, movable arm assembly 6 consists of am armrest supporting structure 27 including plate-like rear portion 28 pivotably mounted to upwardly extending member 16, and an arm portion 29 extending forwardly from rear portion 28, to which an armrest 30 is mounted in accordance with conventional construction. Rear portion 28 includes an opening which receives outer portion 25 of stop pin 24. A pair of nylon washers 31 are placed over pin outer portion 25 on either side of rear portion 28, one of which is located between rear portion 28 and upwardly extending member 16 and the other of which is located between rear portion 28 and a metal washer 31'. A screw 32 extends through washer 31' and into an axial threaded bore formed in the outer end of pin 24, and washers 31 provide a bearing arrangement for facilitating pivoting movement of arm assembly 6. With this arrangement, rear portion 28, and thereby movable arm assembly 6, is pivotable about a pivot axis defined by the longitudinal axis of pin 24. A stop member 33 is mounted to the lower front area of rear portion 28. In a manner to be explained, stop member 33 is engagable with the forward edge of upwardly extending member 16, which is oriented substantially vertically to control the range of pivoting movement of movable arm assembly 6.

In operation, when it is desired to seat a user onto seating assembly 1, arm assembly 6 is moved to its inoperative, transfer position illustrated in FIG. 4 by exerting an upward force on arm 29 to pivot arm assembly 6 clockwise about pin 24. Stop member 33 engages the forward edge of upwardly extending member 16 to prevent further rearward pivoting movement of arm assembly 6. As shown in FIG. 4, the lower edge of rear portion 28 is constructed so as not to extend forwardly of the front surface of back 2 when arm assembly is in its transfer position. With arm assembly 6 in its FIG. 4 transfer position, a user is seated onto seating assembly 1 by means of a transverse, horizontal motion until the user is seated onto seat 4 past arm assembly 6. The user then exerts a downward and forward force on arm assembly 6 to return arm assembly 6 to its user position as illustrated in FIG. 3, in which arm rest 24 functions to support the user's arm. Stop member 33 again engages the forward edge of upwardly extending member 16 to prevent further downward pivoting movement of arm assembly 6 and to maintain arm assembly 6 in its user position.

Arm assembly 6 is pivotable approximately 90° between its user position and its transfer position.

It can thus be appreciated that arm assembly 6 in combination with the structure of base assembly 11 provides easy access for a handicapped person to be seated on seating assembly 1 from the aisle of an auditorium, theater, hall or the like. Base assembly 11 and arm assembly 6 constitute a relatively minor departure from the general appearance and operation of the production version of seating assemblies of this type, as disclosed in the above-referenced patent application, while enabling the owner of an establishment to comply with laws and regulations mandating access for handicapped individuals to certain facilities.

Various alternatives and embodiments are contemplated as being within the scope of the following claims particularly pointing out and distinctly claiming the subject matter regarded as the invention.

I claim:

1. A handicapped accessible seating assembly, comprising:

a seat;

a back;

a movable arm, the arm being movable between a first user position in which the arm extends forwardly of the back and is disposed above the seat, and a second transfer position in which the arm is positioned so as not to extend forwardly of the back, for providing access to the seating assembly from an aisle upon horizontal movement of a user from the aisle onto the seat;

wherein the seat and back are movably mounted to a support for movement independent of each other, wherein the support includes a base adapted for mounting to a support surface; a transverse member extending rearwardly from the base; and an upwardly extending member located adjacent the back extending upwardly from a rearward portion of the transverse member;

wherein the seating assembly includes a substantially vertical plate-like mounting member pivotally mounted to the upwardly extending support member and to which the arm is mounted; and stop structure interposed between the mounting member and the upwardly extending support member for controlling the range of movement of the arm; and wherein the seat is pivotably mounted between an inoperative position and an operative position, wherein the seat in its operative position is adapted to receive a user, and wherein the base and the transverse member are disposed below the uppermost extent of the seat when the seat is in its operative position.

2. The improvement of claim 1, wherein the upwardly extending member of the support is located rearwardly of the seat for preventing interference with transverse movement of a user onto the seat.

3. The improvement of claim 1, wherein the movable arm is movably mounted toward an upper end of the upwardly extending member.

4. A seating assembly, comprising:

a seat;

a back;

a movable arm being movable between a first user position in which the arm extends forwardly of the back and is disposed above the seat, and a second transfer position in which the arm is positioned upwardly so as not to extend forwardly of the back, for providing access to the seating assembly from an aisle upon horizontal movement of a user onto the seat;

wherein the seat and back of the seating assembly are mounted to a support including a base, a transverse member extending rearwardly from the base, and an upwardly extending member extending from a rearward portion of the transverse member, wherein the upwardly extending member includes an edge and wherein the arm is pivotally mounted toward the upper end of the upwardly extending member, and further comprising stop structure interposed between the arm and the upwardly extending member for controlling the range of movement of the arm between its user and transfer positions;

wherein the arm is mounted to an arm support structure pivotally interconnected with the upwardly extending member for providing pivoting movement of the arm, and wherein the stop structure includes a single stop member mounted to the arm support structure, the stop member being engageable with the edge of the upwardly extending member at spaced locations for controlling the range of pivoting movement of the arm.

5. The improvement of claim 4, wherein the arm support structure includes a plate-like portion disposed below the rearward portion of the arm which is pivotally interconnected with the upwardly extending member, and wherein the stop pin is mounted to the plate-like portion and extends therefrom in alignment with the edge of the upwardly extending member.

6. The improvement of claim 4, wherein the stop member and the pivotable connection of the arm support structure to the upwardly extending member are arranged so as to provide a substantially 90° movement of the arm between its user and transfer positions.

7. In a seating system in which a plurality of seating assemblies, each having a seat and a back, are positioned in a side-by-side manner in a series of rows terminating in at least one aisle, the improvement comprising:

a handicapped accessible seating assembly located at the end of at least one of the rows adjacent the aisle having a movable arm located on the aisle, the arm being movable between a first user position in which the arm extends forwardly of the back and is disposed above the seat, and a second transfer position in which the arm is positioned so as not to extend forwardly of the back, for providing access to the seating assembly from the aisle upon horizontal movement of a user from the aisle onto the seat;

wherein the seat and back of the handicapped accessible seating assembly are mounted to a support including a base, a transverse member extending rearwardly from the base, and an upwardly extending member extending from the rearward portion of the transverse member, and wherein the arm is pivotally mounted toward an upper end of the upwardly extending member, and further comprising stop structure interposed between the arm and the upwardly extending member for controlling the range of movement of the arm between its user and transfer positions;

wherein the arm is mounted to an arm support structure pivotally interconnected with the upwardly extending member for providing pivoting movement of the arm, and wherein the stop structure includes a stop member mounted to the arm support structure, the stop member being engageable with the upwardly extending member for controlling the range of pivoting movement of the arm;

wherein the arm support structure includes a plate-like portion disposed below the rearward portion of the arm which is pivotally interconnected with the upwardly extending member; and wherein the back of the seating assembly and the arm support structure are pivotally mounted to the upwardly extending member via a pivot pin, and wherein a stop pin is mounted to the upwardly extending member for limiting pivoting movement of the back relative to the upwardly extending member.

8. The improvement of claim 7, wherein the back of the seat assembly and the arm support structure are pivotably mounted to the upwardly extending member by said pivot pin, wherein said pivot pin defines a head portion extending outwardly from the upwardly extending member, and wherein the arm support structure is pivotally mounted to said pivot pin head portion so as to be pivotable about a pivot axis defined by the longitudinal axis of said pivot pin.

9. A seating assembly, comprising:

a seat and a back mounted to a support, the support including a transverse member extending in a front-rear direction and an upwardly extending member extending upwardly from the rearward end of the transverse member; and an arm movably mounted to the upwardly extending member, the arm being movable between a first user position in which the arm extends forwardly of the back and is disposed above the seat, and a second transfer position in which the arm is positioned so as not to extend forwardly of the back for providing access to the seating assembly from a aisle using a substantially horizontal motion for positioning a user onto the seat;

wherein the arm includes a rear mounting portion pivotally connected to the upwardly extending member for movement between its user and transfer positions, and further comprising stop structure interposed between the rear mounting portion of the arm and the upwardly extending member for controlling the range of movement of the arm; and wherein the seat and the back are each mounted to the support for movement between an operative position and a storage position, wherein the support transverse member is arranged so as not to extend above an upper surface of the seat when the seat is in its operative position and wherein the arm and its mounting portion are arranged so as not to extend forwardly of the back when the back is in its operative position and the arm is in its transfer position.

10. A seating assembly, comprising:

a seat;

a back;

a movable arm being movable between a first user position in which the arm extends forwardly of the back and is disposed above the seat, and a second transfer position in which the arm is positioned upwardly so as not to extend forwardly of the back, for providing access to the seating assembly from an aisle upon horizontal movement of a user onto the seat;

wherein the seat and back of the seating assembly are mounted to a support including a base, a transverse member extending rearwardly from the base, and an upwardly extending member extending from the rearward portion of the transverse member, and wherein the arm is pivotally mounted toward an upper end of the upwardly extending member, and further comprising stop structure interposed between the arm and the upwardly extending member for controlling the range of movement of the arm between its user and transfer positions;

wherein the arm is mounted to an arm support structure pivotally interconnected with the upwardly extending member for providing pivoting movement of the arm, and wherein the stop structure includes a single stop member mounted to the arm support structure; and wherein the upwardly extending member defines an edge with which the stop member is engageable at a pair of spaced locations, for controlling the range of movement of the arm and movement of the stop member as the arm is moved between the first user position and the second transfer position.

* * * * *

UNITED STATES PATENT AND TRADEMARK OFFICE

CERTIFICATE OF CORRECTION

PATENT NO. : 5,567,016

DATED : October 22, 1996

INVENTOR(S) : RICHARD A. KOPROWSKI

It is certified that error appears in the above-identified patent and that said Letters Patent is hereby corrected as shown below:

On the title page, item

[56] References Cited, Please add: -- U.S. Patents: 444,101, 1/1891, Miller; 1,435,741, 11/1922, Sadler; 1,437,630, 12/1922, Zimmerli; 2,124,893, 7/1938, Peppas; 2,336,128, 12/1943, Ronk; 2,560,925, 7/1951, Brown; 2,582,599, 1/1952, Nordmark; 2,705,526, 4/1955, Hoven et al; 2,796,920, 6/1957, Cowles; 2,913,039, 11/1959, Mauser; 3,163,409, 12/1964, Running et al; 3,194,601, 7/1965, Hoven et al; 3,272,555, 9/1966, Barecki et al; 3,572,826, 3/1971, Barnes; 3,638,998, 2/1972, Anderson; 3,813,149, 5/1974, Lawrence, III et al; 3,820,845, 6/1974, Persson; 4,049,315, 9/1977, Jacobson; 4,189,876, 2/1980, Crossman et al; 4,211,450, 7/1980, Sutter; 4,400,031, 8/1983, DeDecker; 4,458,943, 7/1984, Krakauer; 4,502,731, 3/1985, Snider; 4,575,150, 3/1986, Smith; 4,756,575, 7/1988, Dicks; 4,861,108, 8/1989, Acton et al; Foreign Patent Documents: 669162, 12/1938, Germany; 235586, 3/1926, Great Britain;

UNITED STATES PATENT AND TRADEMARK OFFICE

CERTIFICATE OF CORRECTION

PATENT NO. : 5,567,016

DATED : October 22, 1996

INVENTOR(S) : RICHARD A. KOPROWSKI

It is certified that error appears in the above-identified patent and that said Letters Patent is hereby corrected as shown below:

Other References: Brochure entitled "Ikira" JG Furniture Systems, Quakertown, PA 18951, undated"; Brochure entitled "Theatrum Series", Assigned Manufacturing Group, P.O. Box 3786, Industry, CA 91744, undated; Brochure entitled "Auditorium Seating", JG Furniture Systems, Quakertown, PA 18951, undated; Brochure entitled "The Citation", Adirondack Direct, Long Island City, NY 11106, undated --

Signed and Sealed this

Twenty-ninth Day of April, 1997

*Attest:*

Bruce Lehman

BRUCE LEHMAN

*Attesting Officer*

*Commissioner of Patents and Trademarks*